US006745955B2

(12) United States Patent
Kronz

(10) Patent No.: US 6,745,955 B2
(45) Date of Patent: Jun. 8, 2004

(54) SPRAYING APPARATUS

(75) Inventor: Michael Kronz, Middleton, WI (US)

(73) Assignee: Remote Orbital Installations Inc., Middleton, WI (US)

( * ) Notice: Subject to any disclaimer, the term of this patent is extended or adjusted under 35 U.S.C. 154(b) by 67 days.

(21) Appl. No.: 10/198,247

(22) Filed: Jul. 18, 2002

(65) Prior Publication Data

US 2003/0052189 A1 Mar. 20, 2003

Related U.S. Application Data

(60) Provisional application No. 60/305,903, filed on Jul. 18, 2001.

(51) Int. Cl.[7] ..... B05B 3/00

(52) U.S. Cl. ..... 239/227; 239/225.1; 239/226; 239/232; 239/243; 239/247

(58) Field of Search ..... 239/225.1, 226, 239/227, 232, 243, 245, 247, 223, 224

(56) References Cited

U.S. PATENT DOCUMENTS 3,460,988 A * 8/1969 Dineen et al. ..... 239/227
4,211,367 A * 7/1980 Allison ..... 239/226

* cited by examiner

*Primary Examiner*—Robin O. Evans

(74) *Attorney, Agent, or Firm*—David J. Archer

(57) ABSTRACT

A spraying apparatus is disclosed for spraying coating material onto an internal wall of a cylindrical structure having an opening. The apparatus includes a spraying assembly which has a first and a second end. A support is secured to the spraying assembly, the support being selectively movable relative to the opening of the structure for permitting movement of the second end of the spraying assembly axially relative to the structure. A first conduit has a first and a second extremity, the first extremity of the first conduit being connected to a source of a first component of the coating material. The second extremity of the first conduit is connected to the second end of the spraying assembly. A second conduit has a first and a second termination, the first termination of the second conduit being connected to a further source of a second component of the coating material. The second termination of the second conduit is connected to the second end of the spraying assembly. A spray head is connected to the second end of the spraying assembly. The spray head includes a coupling for rotatably coupling the spray head to the second end of the spraying assembly. A nozzle is connected to the coupling, the nozzle being in fluid communication with the second extremity of the first conduit. The nozzle includes a mixing chamber such that when the spray head is disposed within the structure and is rotated relative to the spraying assembly, the first and second components of the coating material are sprayed onto the internal wall of the structure through the nozzle.

19 Claims, 11 Drawing Sheets

SPRAYING APPARATUS

This application claims the benefit of Provisional Application Serial No. 60/305,903, filed Jul. 18, 2001.

BACKGROUND OF THE INVENTION

1. Field of the Invention

The present invention relates to a spraying apparatus for spraying coating material onto an internal wall of a cylindrical structure. More particularly, the present invention relates to a spraying apparatus for spraying coating material which has a first and a second component.

2. Background Information

Most cities are provided with underground structures for gaining access to public electrical systems and sewers which run under the streets. Such structures which are usually of cylindrical configuration are typically provided with a sealing and support lining. In order to prevent water damage and corrosion from damaging such structures, the wall, ceiling and floor of such structures must periodically be repaired.

Fluid sprayers and coating systems for applying a coating material to the inside of underground access structures and vessels are well known. However, these known systems require the operator thereof to enter into the structure with a coating applicator and to manually spray the walls of the structure with sealant. Not only is the aforementioned process labor intensive but also, the entry into a confined access structure for the application of various chemical coatings presents certain health hazards to the operator.

U.S. Pat. No. 5,405,218 to Hyde Smith discloses the application of an elastomeric material to an underground structure by means of a spray gun used by a workman standing on the bottom of the structure. Additionally, a problem exists in that the workman must maneuver within the structure in order to coat all of the wall surface.

The apparatus according to the present invention overcomes the aforementioned problems by the provision of a robotic spraying assembly that is lowered into an underground structure for spraying an even layer of coating material onto the walls of the structure.

Therefore, it is a primary feature of the present invention to provide a spraying apparatus for spraying coating material that overcomes the problems associated with the prior art arrangements.

Another feature of the present invention is the provision of a spraying apparatus for spraying coating material that applies a coating material of uniform thickness to the structure.

Other features and advantages of the present invention will be readily apparent to those skilled in the art by a consideration of the detailed description of a preferred embodiment of the present invention contained herein.

SUMMARY OF THE INVENTION

The present invention relates to a spraying apparatus for spraying coating material onto an internal wall of a cylindrical structure having an opening. The apparatus includes a spraying assembly which has a first and a second end. A support is secured to the spraying assembly, the support being selectively movable relative to the opening of the structure for permitting movement of the second end of the spraying assembly axially relative to the structure. A first conduit has a first and a second extremity, the first extremity of the first conduit being connected to a source of a first component of the coating material. The second extremity of the first conduit is connected to the second end of the spraying assembly. A second conduit has a first and a second termination, the first termination of the second conduit being connected to a further source of a second component of the coating material. The second termination of the second conduit is connected to the second end of the spraying assembly. A spray head is connected to the second end of the spraying assembly. The spray head includes a coupling for rotatably coupling the spray head to the second end of the spraying assembly. A nozzle is connected to the coupling, the nozzle being in fluid communication with the second extremity of the first conduit. The nozzle includes a mixing chamber for mixing the components. The arrangement is such that when the spray head is disposed within the structure and is rotated relative to the spraying assembly, the first and second components of the coating material are sprayed onto the internal wall of the structure through the nozzle.

In a more specific embodiment of the present invention, the first end of the spraying assembly defines an anchor for anchoring the spraying assembly to the support. More particularly, the anchor is an eye hook.

Moreover, the support includes a cable having a first and a second termination, the second termination of the cable being secured to the first end of the spraying assembly.

The support further includes a pulley which cooperates with the first termination of the cable and a rail which has a first and a second end. The second end of the rail is secured to the pulley. Also, a vehicle is provided for movably supporting the first end of the rail such that when the rail is extended away from the vehicle, the pulley is positionable above the opening of the structure and when the first end of the rail is retracted towards the vehicle, the pulley and spraying assembly suspended therefrom is retracted into the vehicle.

More specifically, the pulley includes a winch and a control for controlling rotation of the winch such that winding of the cable by the winch is permitted so that controlling of an elevation of the spraying assembly relative to the structure is permitted.

Furthermore, the first conduit is a flexible hose and the second conduit is a further flexible hose.

In a preferred embodiment of the present invention, the first component of the coating material is an epoxy primer and the second component of the coating material is a urethane.

Additionally, the coupling includes a rotary spool.

Also, the second end of the spraying assembly defines an inlet port which is connected to the second extremity of the first conduit. The second end of the spraying assembly also defines a further inlet port which is connected to the second termination of the second conduit. Moreover, the second end of the spraying assembly further defines an enclosure for the rotatable reception therein of the rotary spool such that the rotary spool divides the enclosure into a first annular cavity which is connected to the inlet port and a second annular cavity which is connected to the further inlet port.

The rotary spool defines a first channel which connects the first cavity to the mixing chamber of the nozzle and a second channel which connects the second cavity to the mixing chamber. The channels are disposed such that when the rotary spool is rotated relative to the second end of the spraying assembly, the first component of the coating material flows from the source through the first conduit through the inlet port into the first annular cavity and through the first channel into the mixing chamber of the nozzle. Additionally, the second component of the coating material flows from the further source through the second conduit through the further inlet port into the second annular cavity and through the second channel into the mixing chamber of the nozzle for spray application thereof onto the internal wall of the structure.

Additionally, the spraying apparatus includes a motor for controllably rotating the rotary spool relative to the second end of the spraying assembly.

More particularly, the motor includes a belt drive for rotating the rotary spool.

In an alternative embodiment of the present invention, the motor includes a gear drive for rotating the rotary spool.

The spraying apparatus further includes a plurality of support legs which extend from the spraying assembly for centering the spraying assembly within the cylindrical structure.

More specifically, the plurality of support legs includes a first leg which has an inner and an outer end, the inner end being pivotally secured to the spraying assembly. A first wheel is rotatably secured to the outer end of the first leg for engaging the internal wall for assisting in centering the spraying assembly within the structure. Also, a first support arm has a first and a second extremity, the first extremity of the first support arm being pivotally secured to the second end of the spraying assembly. The second extremity of the first support arm is pivotally secured to the first leg between the inner and outer ends thereof.

Also, a second leg has an inner and an outer end, the inner end being pivotally secured to the spraying assembly. A second wheel is rotatably secured to the outer end of the second leg for engaging the internal wall for assisting in centering the spraying assembly within the structure. A second support arm has a first and a second extremity, the first extremity of the second support arm being pivotally secured to the second end of the spraying assembly. The second extremity of the second support arm is pivotally secured to the second leg between the inner and outer ends thereof;

Moreover, a third leg has an inner and an outer end, the inner end being pivotally secured to the spraying assembly. A third wheel is rotatably secured to the outer end of the third leg for engaging the internal wall for assisting in centering the spraying assembly within the structure. Additionally, a third support arm has a first and a second extremity, the first extremity of the third support arm being pivotally secured to the second end of the spraying assembly. The second extremity of the third support arm is pivotally secured to the third leg between the inner and outer ends thereof.

Also, a biasing device is provided for selectively biasing the wheels towards the internal wall.

Furthermore, the spraying assembly includes a first slide for slidably engaging the inner end of the first leg and a second slide for slidably engaging the inner end of the second leg. A third slide is provided for slidably engaging the inner end of the third leg. The arrangement is such that when the wheels are being biased towards the internal wall, the inner ends of the first second and third legs respectively slide axially along the first, second and third slides respectively.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in such modifications would be the application of the spray assembly for coating horizontally disposed pipes and the like. In such an arrangement, the spraying assembly would be movably supported by a horizontally disposed boom or a similar support element.

Additionally, although the concept according to the present invention is particularly applicable to coating cylindrical structures, the apparatus could also be used for coating the internal walls of a structure having a square or rectangular cross sectional configuration.

BRIEF DESCRIPTION OF THE DRAWINGS

Similar reference characters refer to similar parts throughout the various views and embodiments of the drawings.

DETAILED DESCRIPTION OF THE DRAWINGS

Figure 1:
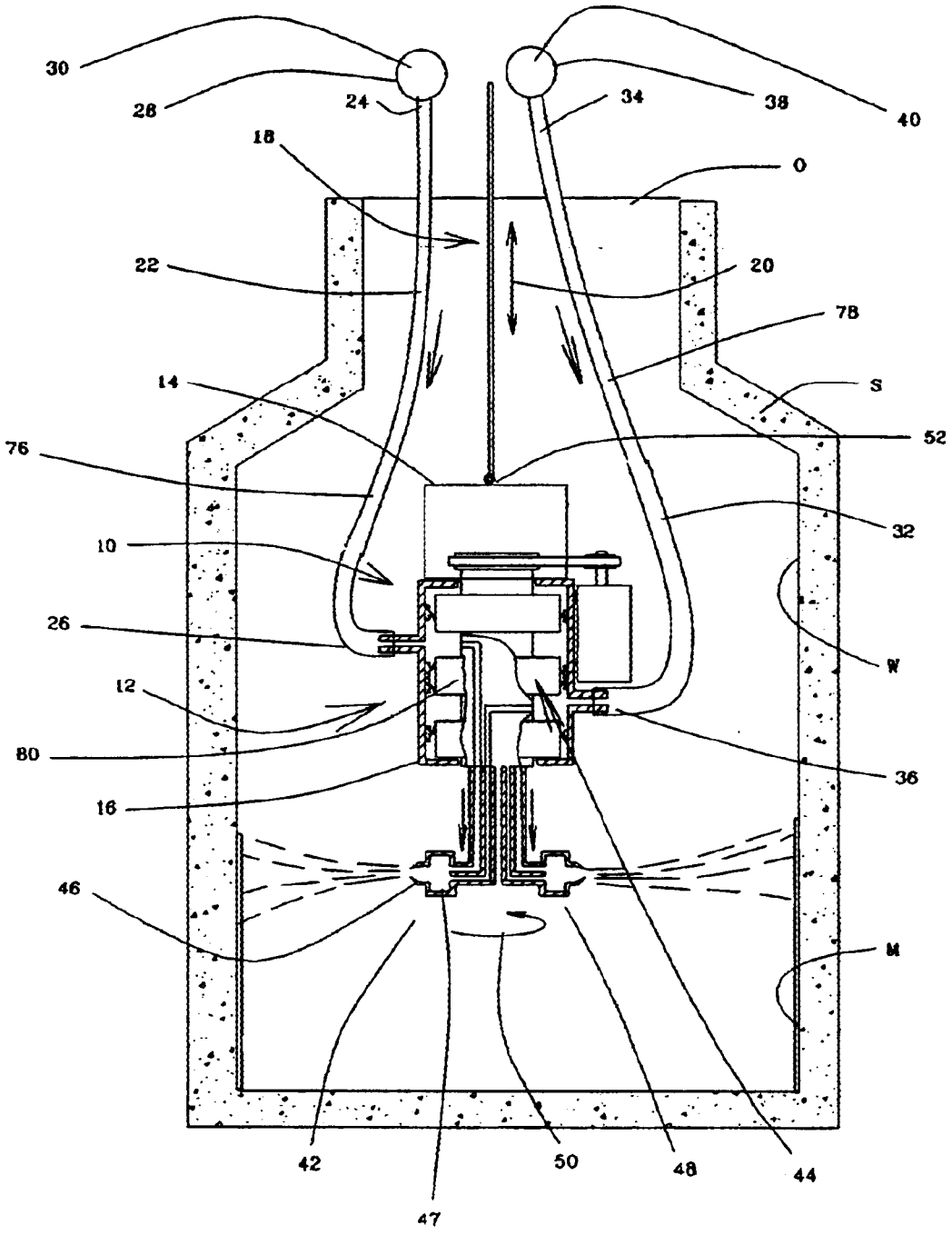
FIG. 1 is a schematic of a spraying apparatus according to the present invention for spraying coating material onto an internal wall of a cylindrical structure having an opening.

FIG. 1 is a schematic of a spraying apparatus according to the present invention for spraying coating material M onto an internal wall W of a cylindrical structure S having an opening O. As shown in FIG. 1, the spraying apparatus generally designated 10 includes a spraying assembly generally designated 12 which has a first and a second end 14 and 16 respectively. A support generally designated 18 is secured to the spraying assembly 12, the support 18 being selectively movable as indicated by the arrow 20 relative to the opening O of the structure S for permitting movement of the second end 16 of the spraying assembly 12 axially as indicated by the arrow 20 relative to the structure S. A first conduit 22 has a first and a second extremity 24 and 26 respectively, the first extremity 24 of the first conduit 22 being connected to a source 28 of a first component 30 of the coating material M. The second extremity 26 of the first conduit 22 is connected to the second end 16 of the spraying assembly 12. A second conduit 32 has a first and a second termination 34 and 36 respectively, the first termination 34 of the second conduit 32 being connected to a further source 38 of a second component 40 of the coating material M. The second termination 36 of the second conduit 32 is connected to the second end 16 of the spraying assembly 12. A spray head generally designated 42 is connected to the second end 16 of the spraying assembly 12. The spray head 42 includes a coupling generally designated 44 for rotatably coupling the spray head 42 to the second end 16 of the spraying assembly 12. A nozzle 46 is connected to the coupling 44, the nozzle 46 being in fluid communication with the second extremity 26 of the first conduit 22. The nozzle includes a mixing chamber 47 for mixing the components 30 and 40. The arrangement is such that when the spray head 42 is disposed within the structure S and is rotated as indicated by the arrow 50 relative to the spraying assembly 12, the first and second components 30 and 40 respectively of the coating material M are sprayed onto the internal wall W of the structure S through the nozzle 46.

In a more specific embodiment of the present invention, the first end 14 of the spraying assembly 12 defines an anchor 52 for anchoring the spraying assembly 12 to the support 18. More particularly, the anchor 52 is an eye hook.

Figure 2:
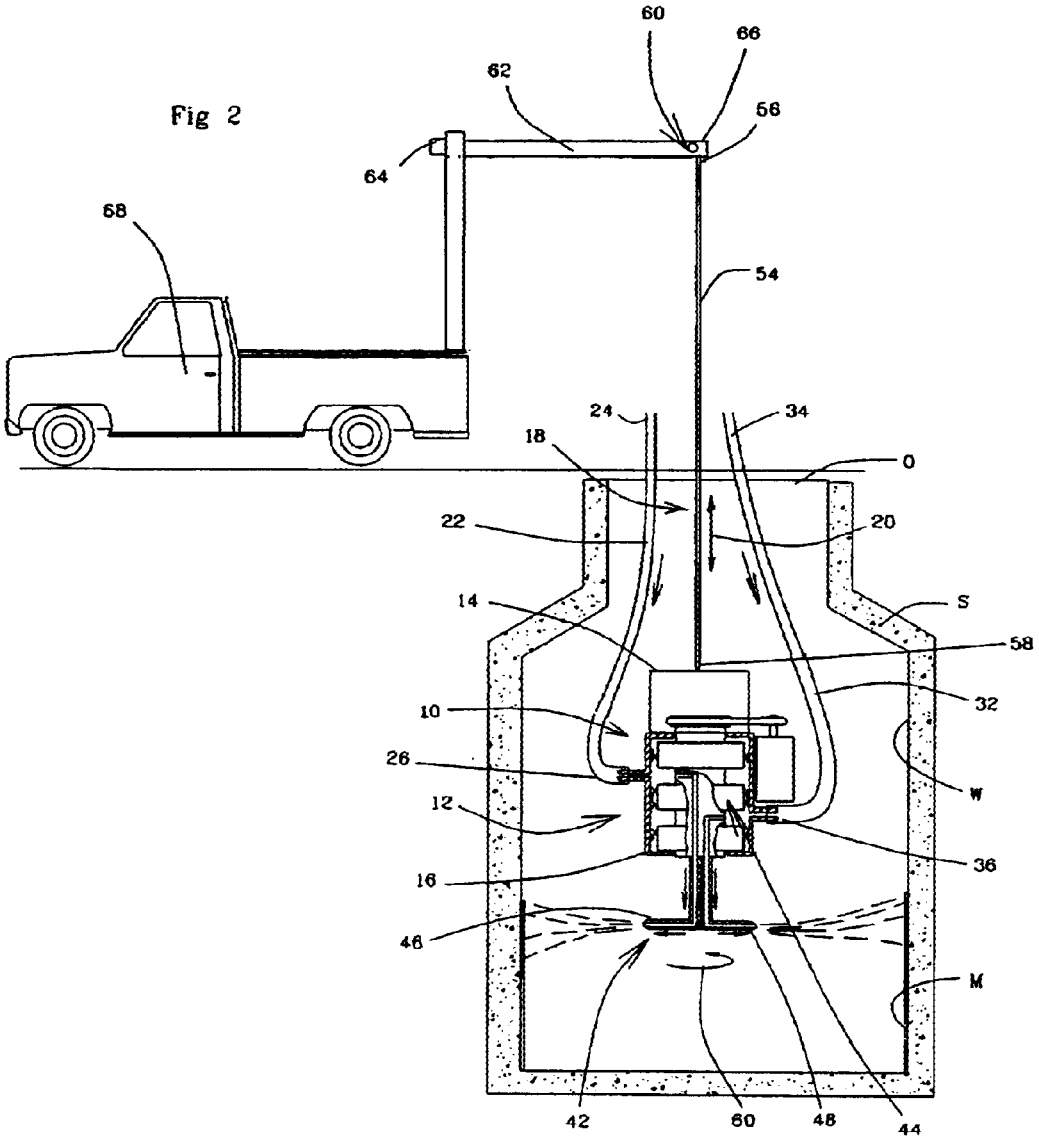
FIG. 2 is a similar view to that shown in FIG. 1 but on a reduced scale.

FIG. 2 is a similar view to that shown in FIG. 1 but on a reduced scale. As shown in FIG. 2, the support 18 includes a cable 54 having a first and a second termination 56 and 58 respectively, the second termination 58 of the cable 54 being secured to the first end 14 of the spraying assembly 12.

The support 18 further includes a pulley generally designated 60 which cooperates with the first termination 56 of the cable 54. Also, the support 18 includes a rail 62 which has a first and a second end 64 and 66 respectively. The second end 66 of the rail 62 is secured to the pulley 60. Also, a vehicle 68 is provided for movably supporting the first end 64 of the rail 62.

Figure 3:
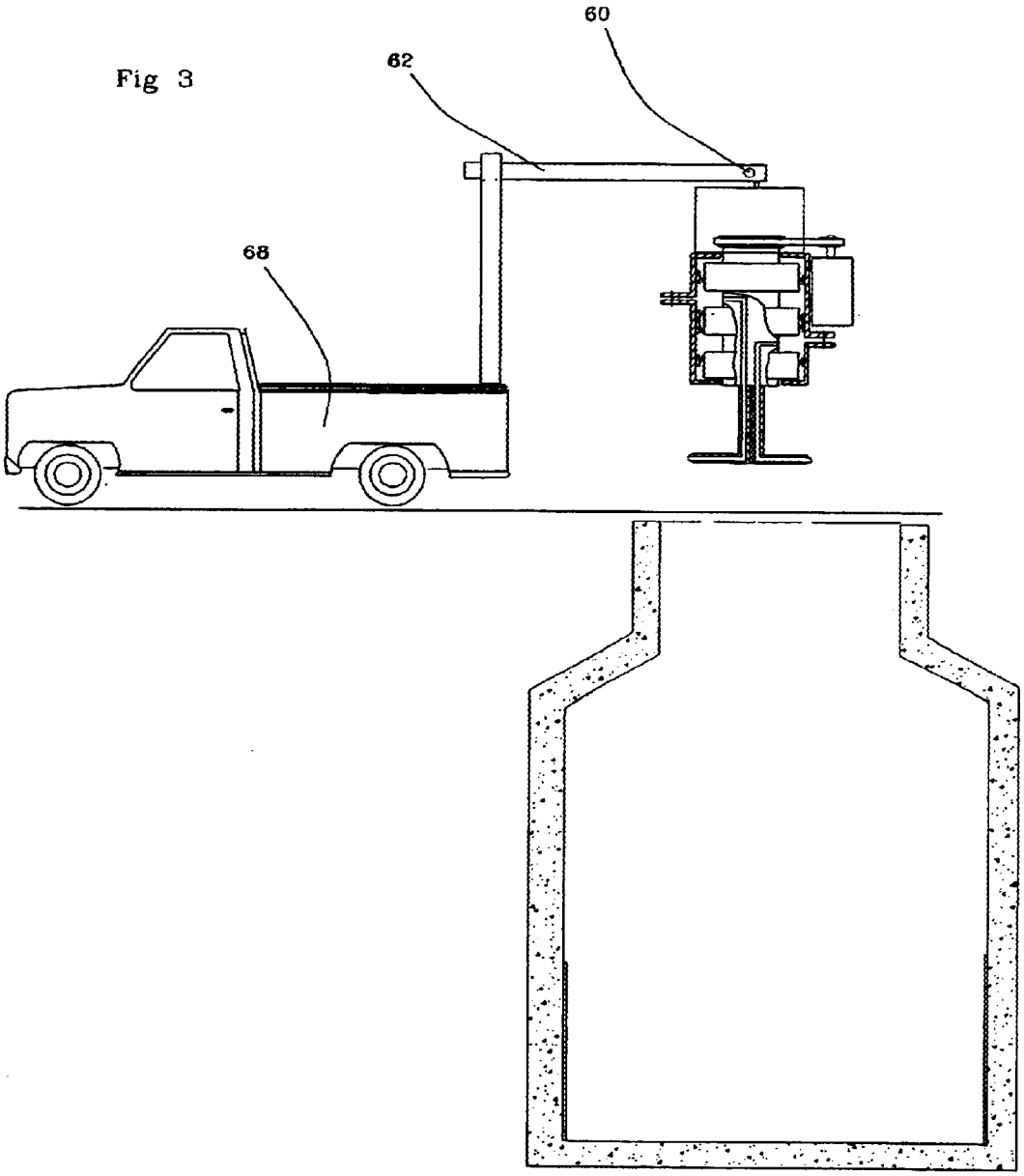
FIG. 3 is a similar view to that shown in FIG. 2 but shows the spraying assembly raised relative to the structure.

FIG. 3 is a similar view to that shown in FIG. 2 but shows the spraying assembly raised. As shown in FIG. 3, when the rail 62 is extended away from the vehicle 68, the pulley 60 is positionable above the opening O of the structure S.

Figure 4:
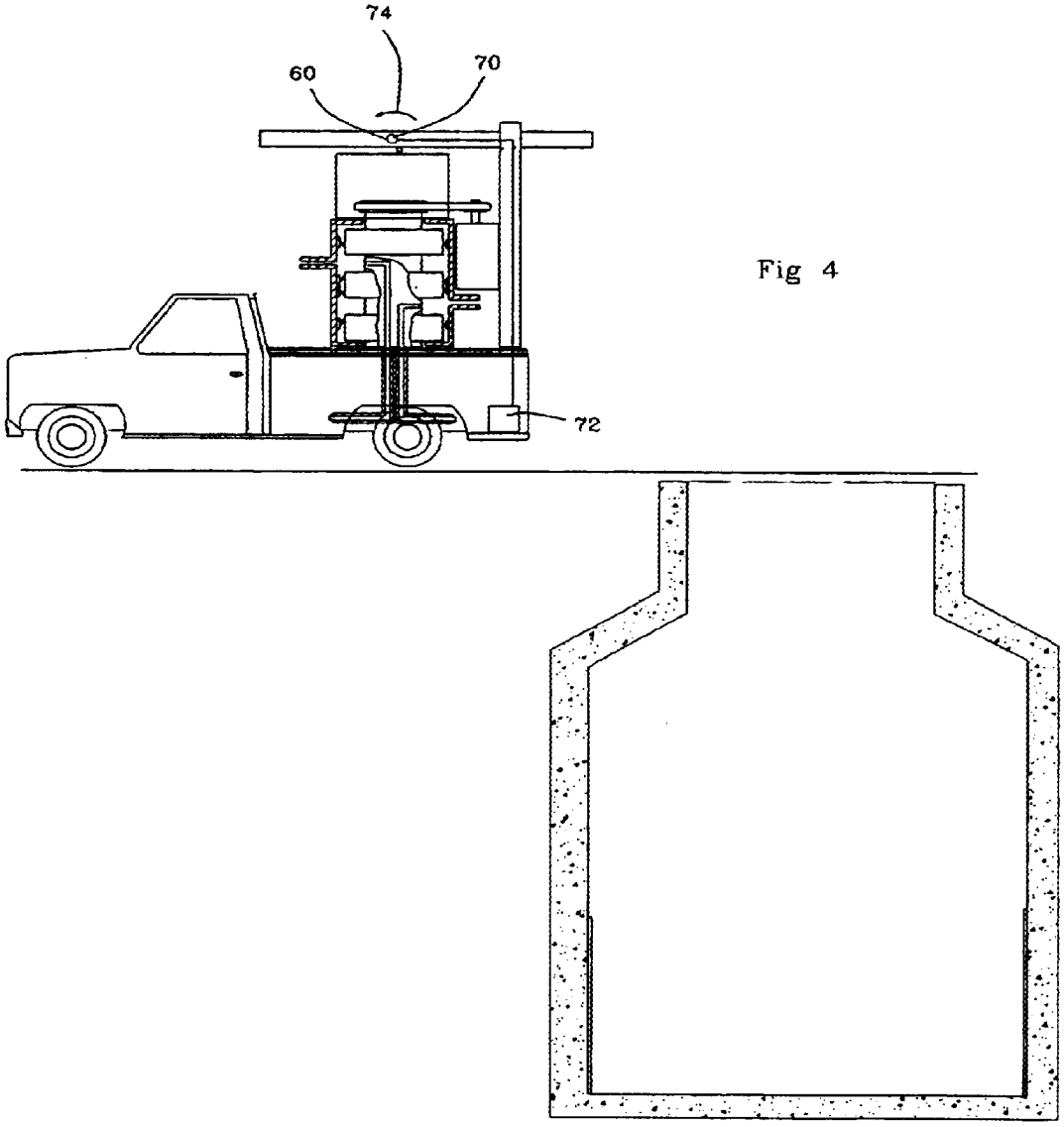
FIG. 4 is a similar view to that shown in FIG. 3 but FIG. 4 shows the rail and spraying assembly retracted.

FIG. 4 is a similar view to that shown in FIG. 3 but FIG. 4 shows the rail retracted. As shown in FIG. 4, when the first end 64 of the rail 62 is retracted towards the vehicle 68, the pulley 60 and spraying assembly 12 suspended therefrom is retracted into the vehicle 68.

More specifically, the pulley 60 includes a winch 70 and a control 72 for controlling rotation of the winch 70 as indicated by the arrow 74 such that winding of the cable 54 by the winch 70 is permitted so that controlling of an elevation of the spraying assembly 12 relative to the structure S is permitted. The control 72 also controls rotation of the spray head 42 and the supply of the components of the coating material to the spray head 42.

Furthermore, as shown in FIG. 1, the first conduit 22 is a flexible hose 76 and the second conduit 32 is a further flexible hose 78.

In a preferred embodiment of the present invention, the first component 30 of the coating material M is an epoxy primer and the second component 40 of the coating material M is a urethane.

Additionally, the coupling 44 includes a rotary spool generally designated 80.

Figure 5:
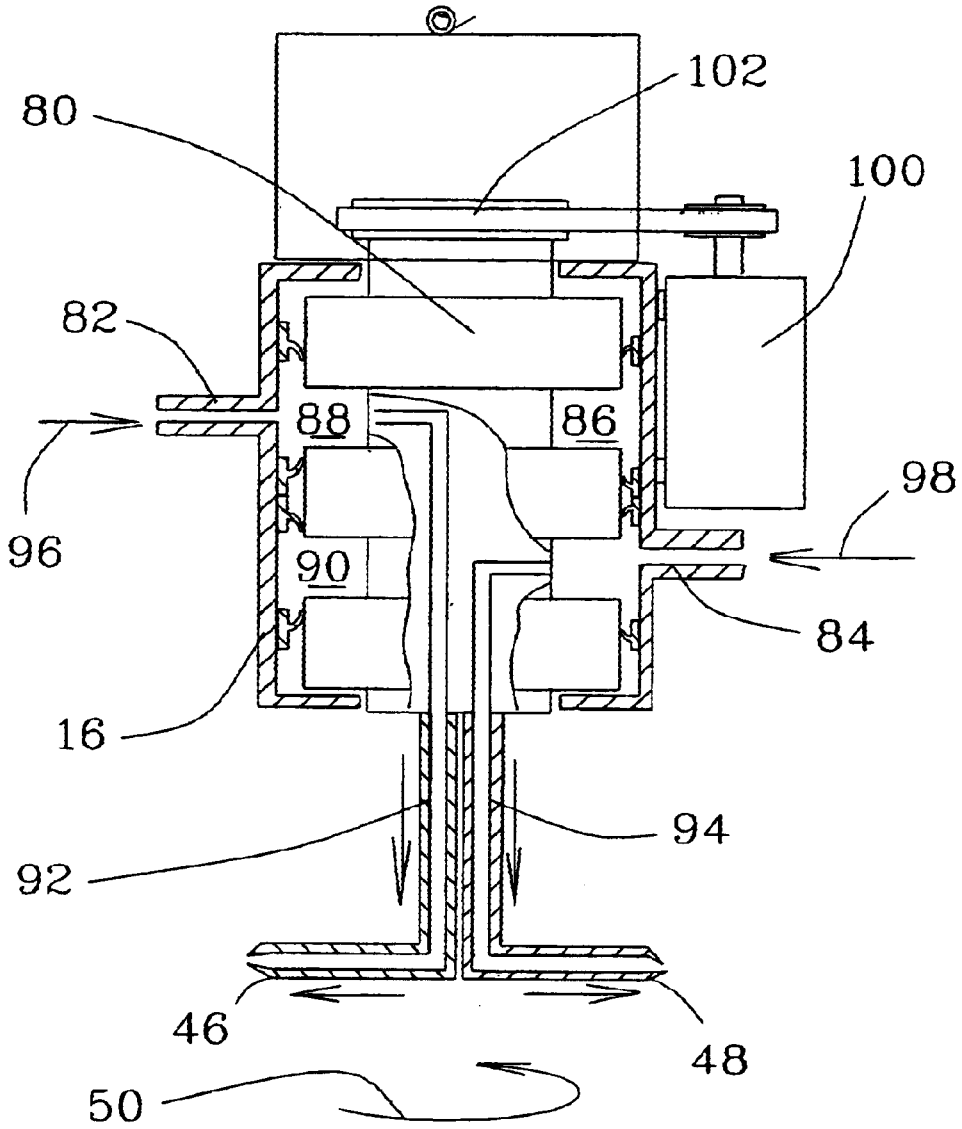
FIG. 5 is a similar view to that shown in FIG. 1 but shows the spraying assembly on an enlarged scale.

FIG. 5 is a similar view to that shown in FIG. 1 but shows the spraying assembly on an enlarged scale. As shown in FIG. 5, the second end 16 of the spraying assembly 12 defines an inlet port 82 which is connected to the second extremity 26 of the first conduit 22. The second end 16 of the spraying assembly 12 also defines a further inlet port 84 which is connected to the second termination 36 of the second conduit 32. Moreover, the second end 16 of the spraying assembly 12 further defines an enclosure generally designated 86 for the rotatable reception therein of the rotary spool 80 such that the rotary spool 80 divides the enclosure 86 into a first annular cavity 88 which is connected to the inlet port 82 and a second annular cavity 90 which is connected to the further inlet port 84.

The rotary spool 80 defines a first channel 92 which connects the first cavity 88 to the first nozzle 46 and a second channel 94 which connects the second cavity 90 to the mixing chamber 47. The channels 92 and 94 respectively are disposed such that when the rotary spool 80 is rotated as indicated by the arrow 50 relative to the second end 16 of the spraying assembly 12, the first component 30 of the coating material M flows as indicated by the arrow 96 from the source 28 through the first conduit 22 through the inlet port 82 into the first annular cavity 88 and through the first channel 92 into the mixing chamber 47 to the nozzle 46. Additionally, the second component 40 of the coating material M flows as indicated by the arrow 98 from the further source 38 through the second conduit 32 through the further inlet port 84 into the second annular cavity 90 and through the second channel 94 into the mixing chamber 47 for mixing the components 30 and 40 and for spray application of the mixed components 30 and 40 onto the internal wall W of the structure S.

Additionally, the spraying apparatus 10 includes a motor 100 for controllably rotating the rotary spool 80 relative to the second end 16 of the spraying assembly 12 as indicated by the arrow 50.

More particularly, the motor 100 includes a belt drive 102 for rotating the rotary spool 80.

Figure 6:
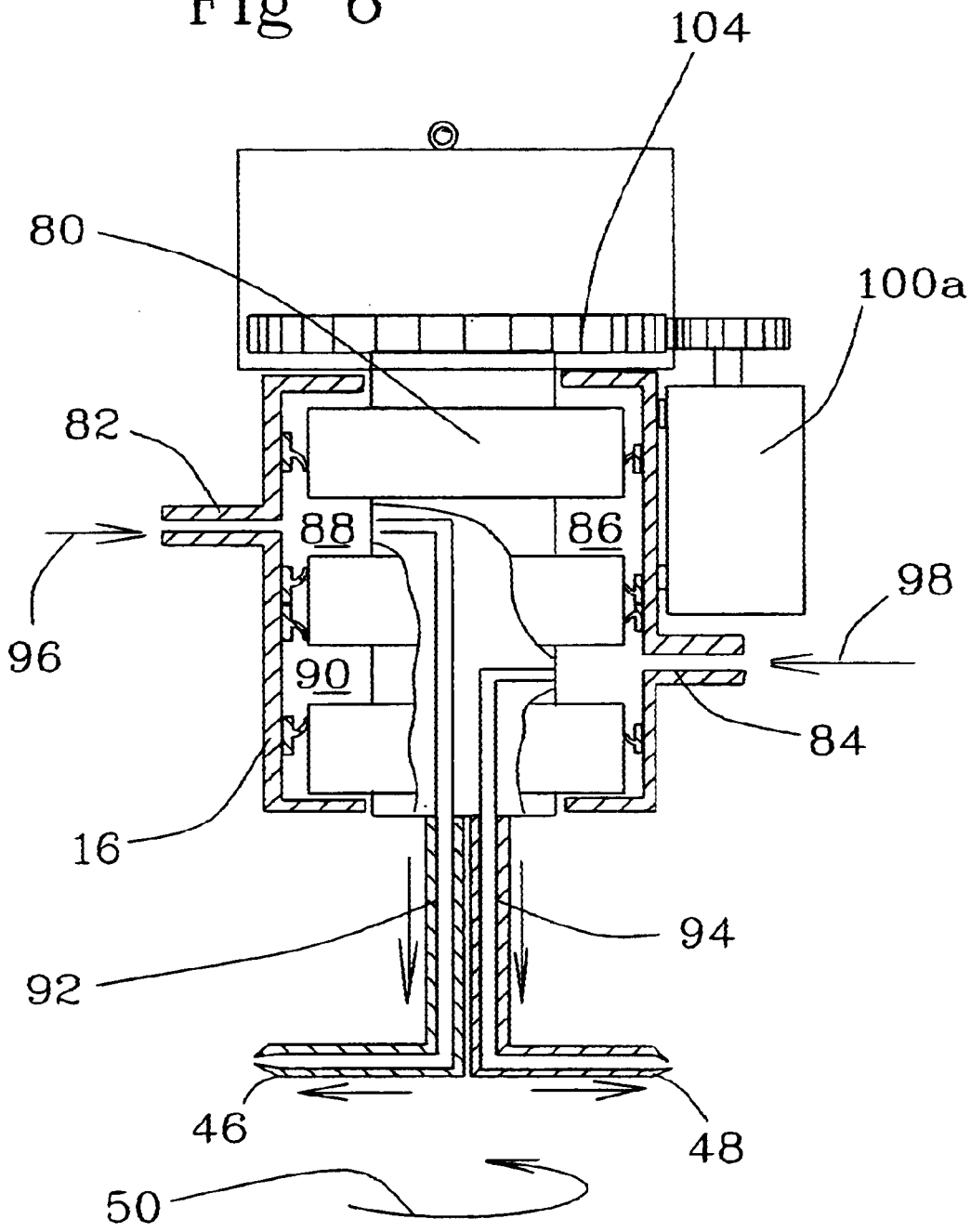
FIG. 6 is a similar view to that shown in FIG. 5 but shows an alternative embodiment of the present invention.

FIG. 6 is a similar view to that shown in FIG. 5 but shows an alternative embodiment of the present invention. As shown in FIG. 6, a motor **100*a* includes a gear drive 104 for rotating the rotary spool 80**.

Figure 7:
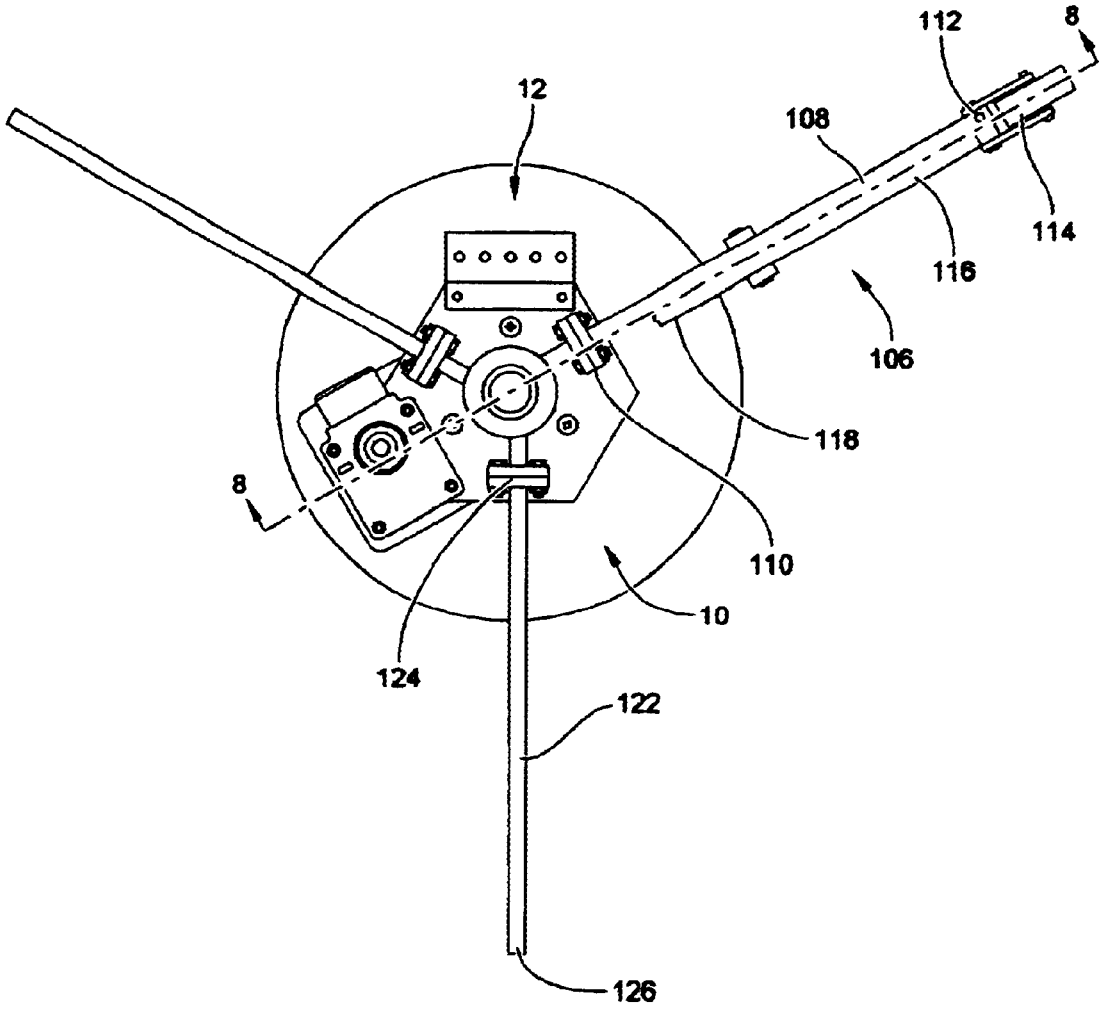
FIG. 7 is a top plan view of a commercial application of the apparatus according to the present invention.

FIG. 7 is a top plan view of a commercial application of the apparatus according to the present invention. As shown in FIG. 7, the spraying apparatus 10 further includes a plurality of support legs generally designated 106 which extend from the spraying assembly 12 for centering the spraying assembly 12 within the cylindrical structure S.

More specifically, the plurality of support legs 106 includes a first leg 108 which has an inner and an outer end 110 and 112 respectively, the inner end 110 being pivotally secured to the spraying assembly 12. A first wheel 114 is rotatably secured to the outer end 112 of the first leg 108 for engaging the internal wall W for assisting in centering the spraying assembly 12 within the structure S.

Figure 8:
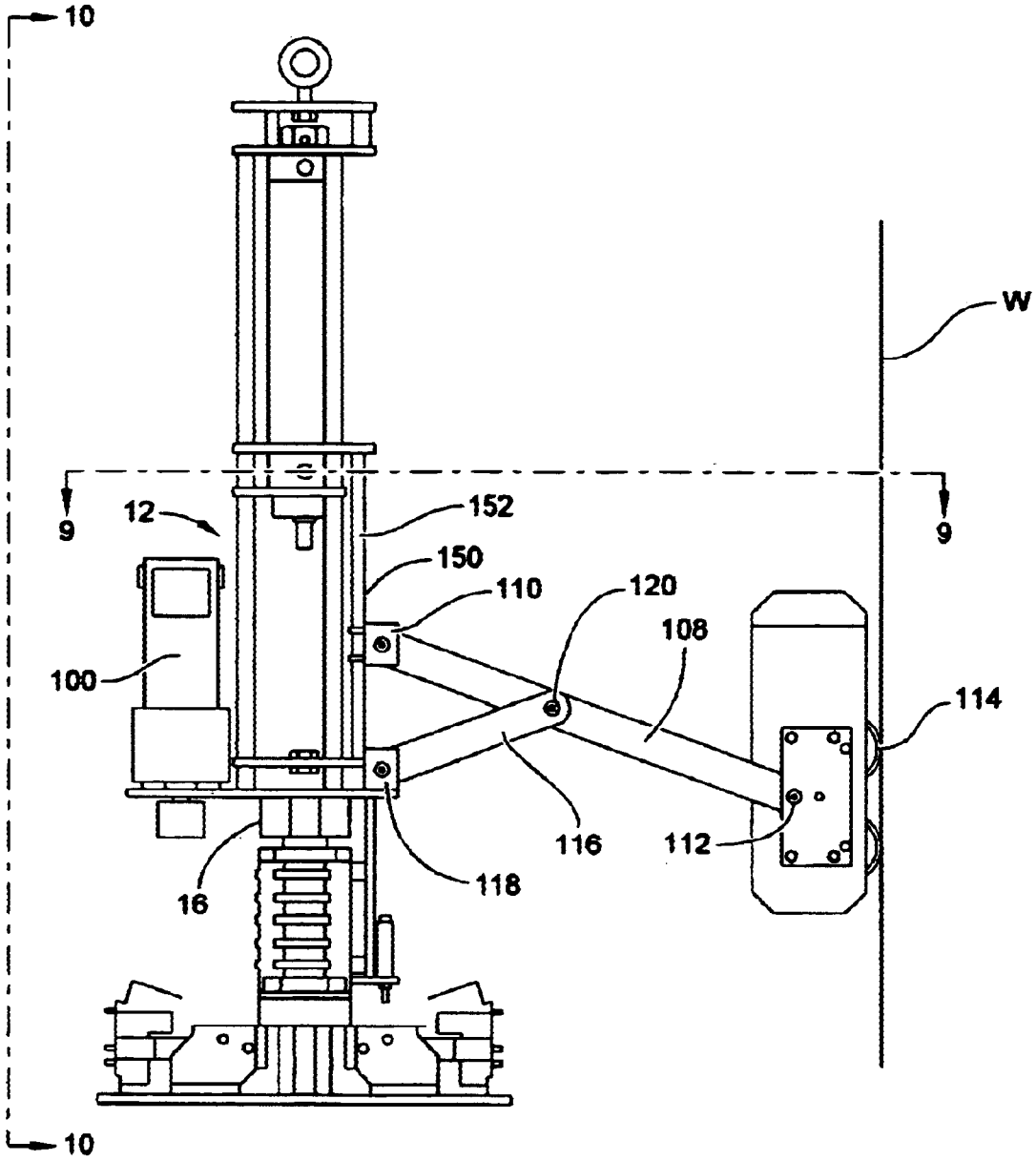
FIG. 8 is a sectional view taken on the line 8—8 of FIG. 7.

FIG. 8 is a sectional view taken on the line 8—8 of FIG. 7. As shown in FIG. 8, a first support arm 116 has a first and a second extremity 118 and 120 respectively, the first extremity 118 of the first support arm 116 being pivotally secured to the second end 16 of the spraying assembly 12. The second extremity 120 of the first support arm 116 is pivotally secured to the first leg 108 between the inner end 110 and outer end 112 thereof.

Figure 9:
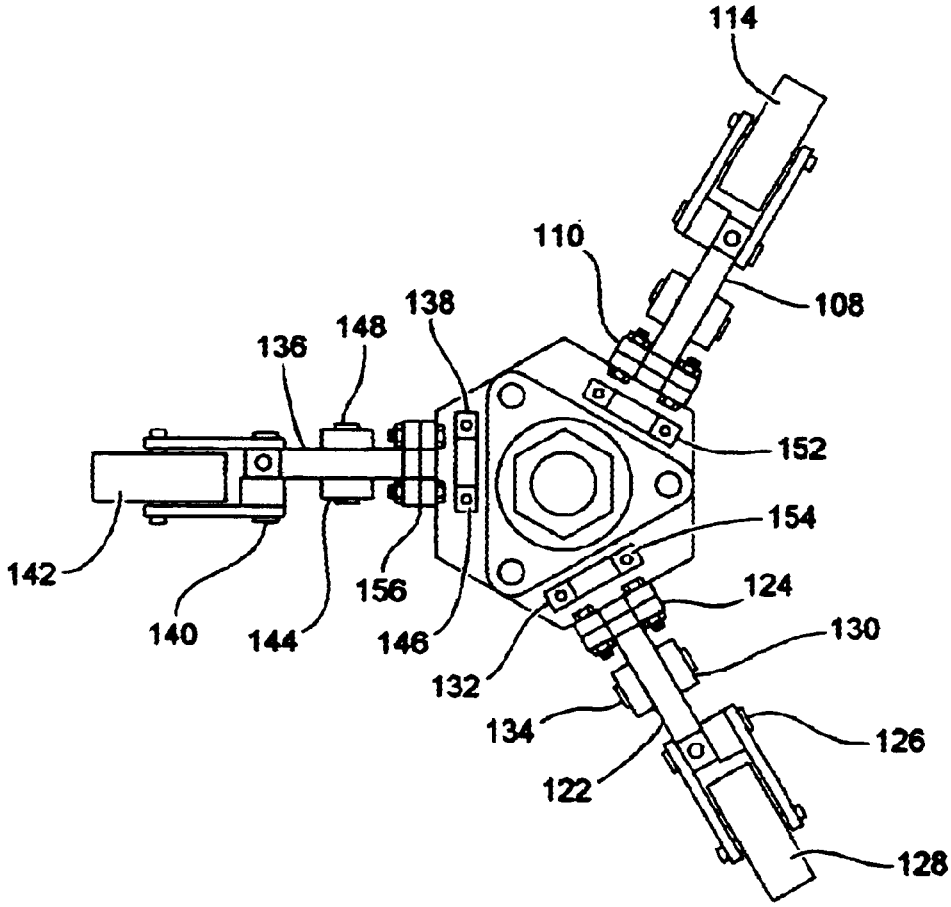
FIG. 9 is a view taken on the line 9—9 of FIG. 8.

FIG. 9 is a view taken on the line 9—9 of FIG. 8. As shown in FIG. 9, a second leg 122 has an inner and an outer end 124 and 126 respectively, the inner end 124 being pivotally secured to the spraying assembly 12. A second wheel 128 is rotatably secured to the outer end 126 of the second leg 122 for engaging the internal wall W for assisting in centering the spraying assembly 12 within the structure S. A second support arm 130 has a first and a second extremity 132 and 134 respectively, the first extremity 132 of the second support arm 130 being pivotally secured to the second end 16 of the spraying assembly 12. The second extremity 134 of the second support arm 130 is pivotally secured to the second leg 122 between the inner end 124 and outer end 126 thereof;

Moreover, a third leg 136 has an inner and an outer end 138 and 140 respectively, the inner end 138 being pivotally secured to the spraying assembly 12. A third wheel 142 is rotatably secured to the outer end 140 of the third leg 136 for engaging the internal wall W for assisting in centering the spraying assembly 12 within the structure S. Additionally, a third support arm 144 has a first and a second extremity 146 and 148 respectively, the first extremity 146 of the third support arm 144 being pivotally secured to the second end 16 of the spraying assembly 12. The second extremity 148 of the third support arm 144 is pivotally secured to the third leg 136 between the inner end 138 and outer end 140 thereof.

Also, as shown in FIG. 8, a biasing device 150 is provided for selectively biasing the wheels 114, 128 and 142 respectively outwardly towards the internal wall W.

Furthermore, the spraying assembly 12 includes a first slide 152 for slidably engaging the inner end 110 of the first leg 108. As shown in FIG. 9, a second slide 154 is provided for slidably engaging the inner end 124 of the second leg 122. A third slide 156 is provided for slidably engaging the inner end 138 of the third leg 136. The arrangement is such that when the wheels 114, 128 and 142 are being biased towards the internal wall W, the inner ends 110, 124 and 138 of the first second and third legs 108, 12 and 136 respectively slide axially along the first, second and third slides 152, 154 and 156 respectively.

Figure 10:
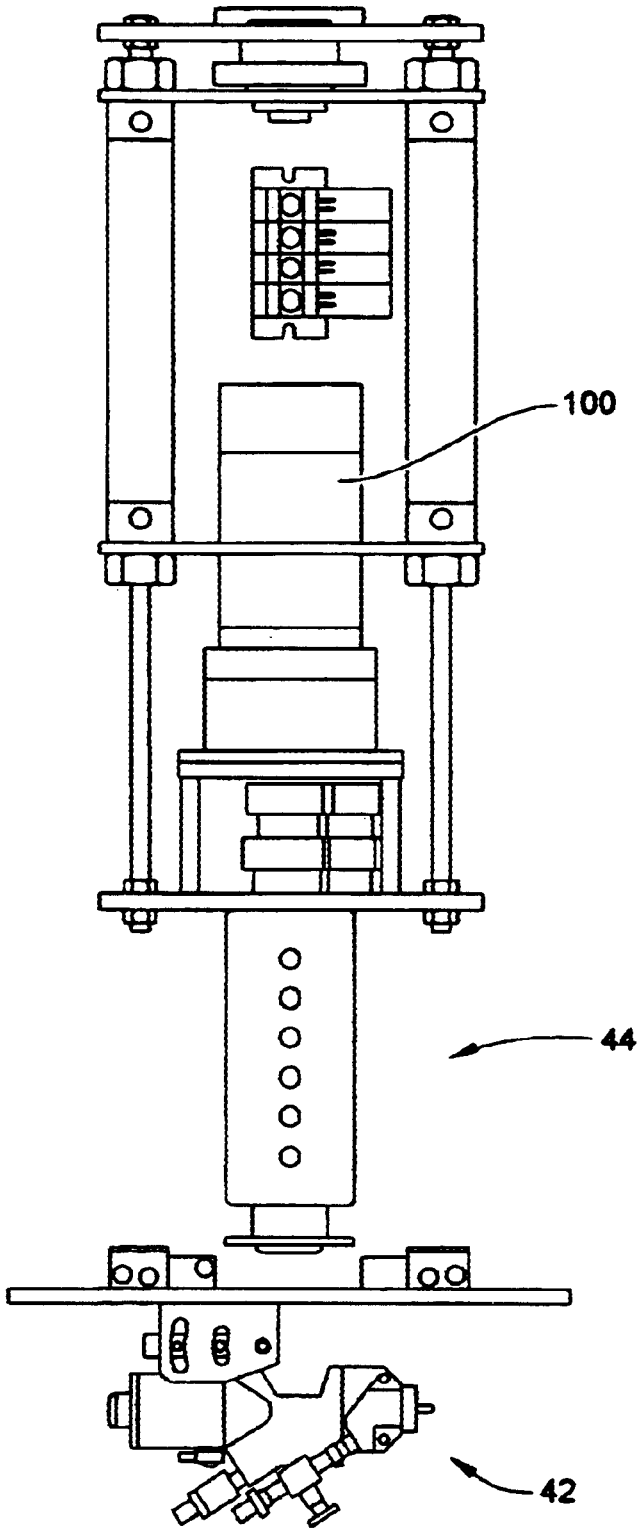
FIG. 10 is a sectional view taken on the line 10—10 of FIG. 8.

FIG. 10 is a sectional view taken on the line 10—10 of FIG. 8. As shown in FIG. 10, the spray head 42 is removably fastened to the coupling 44.

Figure 11:
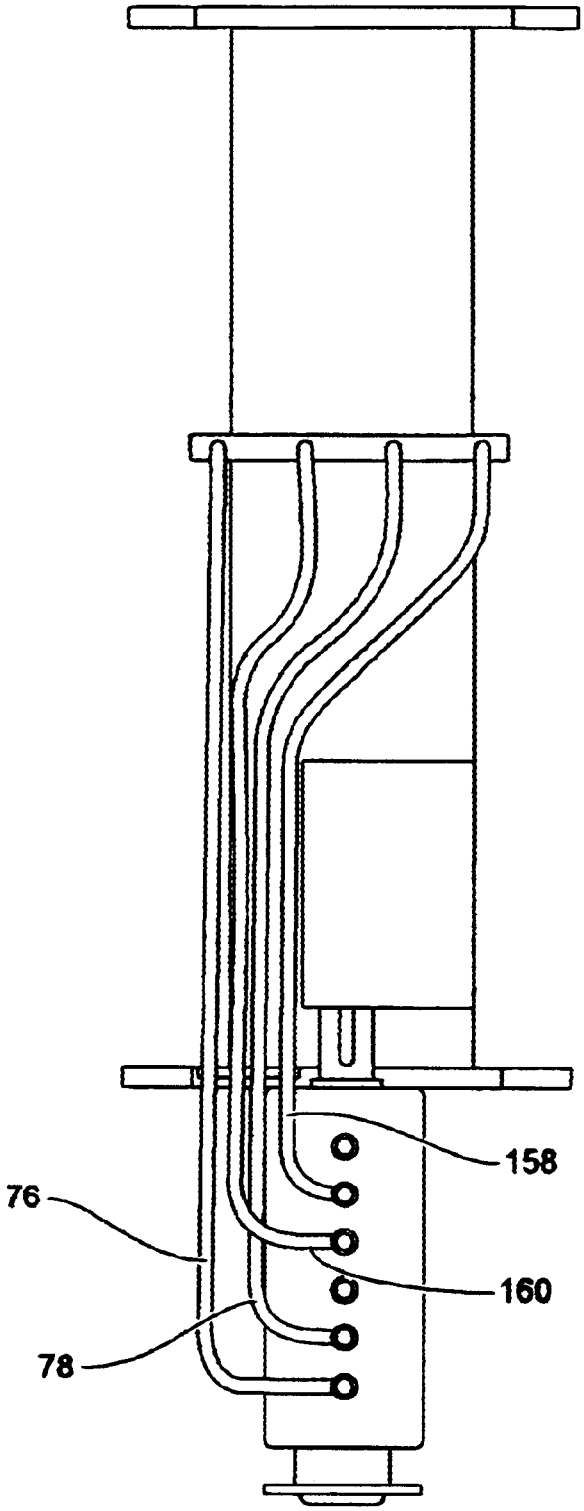
FIG. 11 is a similar view to that shown in FIG. 10 but shows details of the flexible hoses and the provision of air hoses.

FIG. 11 is a similar view to that shown in FIG. 10 but shows details of the flexible hose and the provision of air hoses 158 and 160 therebetween.

In operation of the apparatus 10 according to the present invention, the operator initially blasts the walls W with abrasive media via the air hoses 158 and 160. Any water or corrosion damage is manually repaired by drilling and hand filling with a trowel using a quick drying mortar.

The rail is then extended as shown in FIG. 3 and the spraying assembly 12 is lowered into the structure S as shown in FIG. 2. The components 30 and 40 are then supplied under pressure to the nozzle 46 while the motor 100 rotates the nozzle 46 as indicated by the arrow 50. The components 30 and 40 are mixed in the mixing chamber and are evenly sprayed on the wall W and the spraying assembly 12 is controllably raised by the winch 70 so that the wall is progressively sprayed from the bottom to the top thereof. When the spraying has been completed, a top coating of urethane is applied through a further nozzle 48. The further nozzle 48 like the nozzle 46 includes a further mixing chamber which is also supplied with two components in a manner substantially the same as described herein with regard to the components 30 and 40. It will be understood by those skilled in the art that air hoses can be incorporated into the spraying assembly for connection to the mixing chamber and to the further mixing chamber for propelling the respective mixed component.

Usually, the wall will be coated by the nozzle 46 and within 6 minutes, the top coating will then be applied through the further nozzle. When the coating and top coating have been applied, the spraying assembly 12 is raised out of the structure S and the rail 62 is retracted so that the spraying assembly 12 can be stowed on the vehicle 68.

The present invention provides a unique apparatus and method for remotely spraying coating material onto a wall of an underground structure.

What is claimed is:

1. A spraying apparatus for spraying coating material onto an internal wall of a cylindrical structure having an opening, said apparatus comprising:

a spraying assembly having a first and a second end;

a support secured to spraying assembly, said support being selectively movable relative to the opening of the structure for permitting movement of said second end of said spraying assembly axially relative to the structure;

a first conduit having a first and a second extremity, said first extremity of said first conduit being connected to a source of a first component of the coating material, said second extremity of said first conduit being connected to said second end of said spraying assembly;

a second conduit having a first and a second termination, said first termination of said second conduit being connected to a further source of a second component of the coating material, said second termination of said second conduit being connected to said second end of said spraying assembly;

a spray head connected to said second end of said spraying assembly;

said spray head including:

a coupling for rotatably coupling said spray head to said second end of said spraying assembly;

a nozzle connected to said coupling;

said nozzle being in fluid communication with said second extremity of said first conduit; and said nozzle includes:

a mixing chamber for mixing said components such that when said spray head is disposed within the structure and is rotated relative to said spraying assembly, the first and second components of the coating material are sprayed onto the internal wall of the structure through said nozzle.

2. A spraying apparatus as set forth in claim 1 wherein said first end of said spraying assembly defines an anchor for anchoring said spraying assembly to said support.

3. A spraying apparatus as set forth in claim 2 wherein said anchor is an eye hook.

4. A spraying apparatus as set forth in claim 1 wherein said support includes:

a cable having a first and a second termination, said second termination of said cable being secured to said first end of said spraying assembly.

5. A spraying apparatus as set forth in claim 4 wherein said support further includes:

a pulley which cooperates with said first termination of said cable;

a rail having a first and a second end, said second end of said rail being secured to said pulley;

a vehicle for movably supporting said first end of said rail such that when said rail is extended away from said vehicle, said pulley is positionable above the opening of the structure and when said first end of said rail is retracted towards said vehicle, said pulley and spraying assembly suspended therefrom is retracted into said vehicle.

6. A spraying apparatus as set forth in claim 5 wherein said pulley includes:

a winch;

a control for controlling rotation of said winch such that winding of said cable by said winch is permitted so that controlling of an elevation of said spraying assembly relative to the structure is permitted.

7. A spraying apparatus as set forth in claim 1 wherein said first conduit is a flexible hose;

said second conduit is a further flexible hose.

8. A spraying apparatus as set forth in claim 1 wherein said first component of the coating material is an epoxy primer;

said second component of the coating material is a urethane.

9. A spraying apparatus as set forth in claim 1 wherein said coupling includes:

a rotary spool.

10. A spraying apparatus as set forth in claim 9 wherein said second end of said spraying assembly defines an inlet port which is connected to said second extremity of said first conduit;

said second end of said spraying assembly defines a further inlet port which is connected to said second termination of said second conduit;

said second end of said spraying assembly defining an enclosure for the rotatable reception therein of said rotary spool such that said rotary spool divides said enclosure into a first annular cavity which is connected to said inlet port and a second annular cavity which is connected to said further inlet port.

11. A spraying apparatus as set forth in claim 10 wherein said rotary spool defines a first channel which connects said first cavity to said mixing chamber of said nozzle and a second channel which connects said second cavity to said mixing chamber, said channels being disposed such that when said rotary spool is rotated relative to said second end of said spraying assembly, said first component of the coating material flows from the source through said first conduit through said inlet port into said first annular cavity and through said first channel into said mixing chamber of said nozzle and said second component of the coating material flows from the further source through said second conduit through said further inlet port into said second annular cavity and through said second channel into said mixing chamber so that said components are mixed in said mixing chamber for spray application of said mixed components onto the internal wall of the structure.

12. A spraying apparatus as set forth in claim 9 further including:

a motor for controllably rotating said rotary spool relative to said second end of said spraying assembly.

13. A spraying apparatus as set forth in claim 12 wherein said motor includes:

a belt drive for rotating said rotary spool.

14. A spraying apparatus as set forth in claim 12 wherein said motor includes:

a gear drive for rotating said rotary spool.

15. A spraying apparatus as set forth in claim 1 further including:

a plurality of support legs extending from said spraying assembly for centering said spraying assembly within the cylindrical structure.

16. A spraying apparatus as set forth in claim 15 wherein said plurality of support legs includes:

a first leg having an inner and an outer end, said inner end being pivotally secured to said spraying assembly;

a first wheel rotatably secured to said outer end of said first leg for engaging the internal wall for assisting in centering said spraying assembly within the structure;

a first support arm having a first and a second extremity, said first extremity of said first support arm being pivotally secured to said second end of said spraying assembly, said second extremity of said first support arm being pivotally secured to said first leg between said inner and outer ends thereof;

a second leg having an inner and an outer end, said inner end being pivotally secured to said spraying assembly;

a second wheel rotatably secured to said outer end of said second leg for engaging the internal wall for assisting in centering said spraying assembly within the structure;

a second support arm having a first and a second extremity, said first extremity of said second support arm being pivotally secured to said second end of said spraying assembly, said second extremity of said second support arm being pivotally secured to said second leg between said inner and outer ends thereof;

a third leg having an inner and an outer end, said inner end being pivotally secured to said spraying assembly;

a third wheel rotatably secured to said outer end of said third leg for engaging the internal wall for assisting in centering said spraying assembly within the structure;

a third support arm having a first and a second extremity, said first extremity of said third support arm being pivotally secured to said second end of said spraying assembly, said second extremity of said third support arm being pivotally secured to said third leg between said inner and outer ends thereof;

a biasing device for selectively biasing said wheels towards the internal wall.

17. A spraying apparatus as set forth in claim 16 wherein said spraying assembly includes:

a first slide for slidably engaging said inner end of said first leg;

a second slide for slidably engaging said inner end of said second leg;

a third slide for slidably engaging said inner end of said third leg, the arrangement being such that when said wheels are being biased towards the internal wall, said inner ends of said first second and third legs respectively slide axially along said first second and third slides respectively.

18. A spraying apparatus for spraying coating material onto an internal wall of a cylindrical structure having an opening, said apparatus comprising:

a spraying assembly having a first and a second end;

a support secured to spraying assembly, said support being selectively movable relative to the opening of the structure for permitting movement of said second end of said spraying assembly axially relative to the structure;

a first conduit having a first and a second extremity, said first extremity of said first conduit being connected to a source of a first component of the coating material, said second extremity of said first conduit being connected to said second end of said spraying assembly;

a second conduit having a first and a second termination, said first termination of said second conduit being connected to a further source of a second component of the coating material, said second termination of said second conduit being connected to said second end of said spraying assembly;

a spray head connected to said second end of said spraying assembly;

said spray head including:

a coupling for rotatably coupling said spray head to said second end of said spraying assembly;

a nozzle connected to said coupling;

said nozzle being in fluid communication with said second extremity of said first conduit;

said nozzle including:

a mixing chamber for receiving therein said first component of the coating material such that when said spray head is disposed within the structure and is rotated relative to said spraying assembly, the first and second components of the coating material are sprayed onto the internal wall of the structure through said nozzle;

said first end of said spraying assembly defining an anchor for anchoring said spraying assembly to said support;

said anchor being an eye hook;

said support including:

a cable having a first and a second termination, said second termination of said cable being secured to said first end of said spraying assembly;

a pulley which cooperates with said first termination of said cable;

a rail having a first and a second end, said second end of said rail being secured to said pulley;

a vehicle for movably supporting said first end of said rail such that when said rail is extended away from said vehicle, said pulley is positionable above the opening of the structure and when said first end of said rail is retracted towards said vehicle, said pulley and spraying assembly suspended therefrom is retracted into said vehicle;

said pulley including:

a winch;

a control for controlling rotation of said winch such that winding of said cable by said winch is permitted so that controlling of an elevation of said spraying assembly relative to the structure is permitted;

said first conduit being a flexible hose;

said second conduit being a further flexible hose;

said first component of the coating material being an epoxy primer;

said second component of the coating material being a urethane;

said coupling including:

a rotary spool;

said second end of said spraying assembly defining an inlet port which is connected to said second extremity of said first conduit;

said second end of said spraying assembly defining a further inlet port which is connected to said second termination of said second conduit;

said second end of said spraying assembly defining an enclosure for the rotatable reception therein of said rotary spool such that said rotary spool divides said enclosure into a first annular cavity which is connected to said inlet port and a second annular cavity which is connected to said further inlet port;

said rotary spool defines a first channel which connects said first cavity to said mixing chamber of said nozzle and a second channel which connects said second cavity to said mixing chamber, said channels being disposed such that when said rotary spool is rotated relative to said second end of said spraying assembly, said first component of the coating material flows from the source through said first conduit through said inlet port into said first annular cavity and through said first channel into said mixing chamber of said nozzle and said second component of the coating material flows from the further source through said second conduit through said further inlet port into said second annular cavity and through said second channel into said mixing chamber where said first and second components of the coating material are mixed together for spray application thereof through the nozzle onto the internal wall of the structure;

said spraying apparatus further including:

a motor for controllably rotating said rotary spool relative to said second end of said spraying assembly;

said motor including:

a belt drive for rotating said rotary spool;

said spraying apparatus further including:

a plurality of support legs extending from said spraying assembly for centering said spraying assembly within the cylindrical structure;

said plurality of support legs including:

a first leg having an inner and an outer end, said inner end being pivotally secured to said spraying assembly;

a first wheel rotatably secured to said outer end of said first leg for engaging the internal wall for assisting in centering said spraying assembly within the structure;

a first support arm having a first and a second extremity, said first extremity of said first support arm being pivotally secured to said second end of said spraying assembly, said second extremity of said first support arm being pivotally secured to said first leg between said inner and outer ends thereof;

a second leg having an inner and an outer end, said inner end being pivotally secured to said spraying assembly;

a second wheel rotatably secured to said outer end of said second leg for engaging the internal wall for assisting in centering said spraying assembly within the structure;

a second support arm having a first and a second extremity, said first extremity of said second support arm being pivotally secured to said second end of said spraying assembly, said second extremity of said second support arm being pivotally secured to said second leg between said inner and outer ends thereof;

a third leg having an inner and an outer end, said inner end being pivotally secured to said spraying assembly;

a third wheel rotatably secured to said outer end of said third leg for engaging the internal wall for assisting in centering said spraying assembly within the structure;

a third support arm having a first and a second extremity, said first extremity of said third support arm being pivotally secured to said second end of said spraying assembly, said second extremity of said third support arm being pivotally secured to said third leg between said inner and outer ends thereof;

a biasing device for selectively biasing said wheels towards the internal wall;

said spraying assembly including:

a first slide for slidably engaging said inner end of said first leg;

a second slide for slidably engaging said inner end of said second leg; and a third slide for slidably engaging said inner end of said third leg, the arrangement being such that when said wheels are being biased towards the internal wall, said inner ends of said first second and third legs respectively slide axially along said first second and third slides respectively.

19. A method for spraying coating material onto an internal wall of a cylindrical structure having an opening, said method comprising the steps of:

lowering a spraying assembly having a first and a second end into the structure;

supplying a first component of the coating material through a first conduit having a first and a second extremity, the first extremity of the first conduit being connected to a source of the first component of the coating material, the second extremity of the first conduit being connected to the second end of the spraying assembly;

supplying a second component of the coating material through a second conduit having a first and a second termination, the first termination of the second conduit being connected to a further source of the second component of the coating material, the second termination of the second conduit being connected to said second end of the spraying assembly;

connecting a spray head to the second end of the spraying assembly, the spray head including:

a coupling for rotatably coupling the spray head to the second end of the spraying assembly;

a nozzle connected to the coupling;

the nozzle being in fluid communication with said second extremity of said first conduit; and rotating the spray head relative to the spraying assembly such that when spray head is disposed within the structure and is rotated relative to said spraying assembly, the first and second components of the coating material are sprayed onto the internal wall of the structure through the nozzle.

* * * * *